United States Patent [19]

Takasugi et al.

[11] 4,133,292

[45] Jan. 9, 1979

[54] WET-DEVELOPING STATIONARY ELECTRODE

[75] Inventors: Noboru Takasugi, Higashi Yamato; Yoshiro Suzuki, Hachioji, both of Japan

[73] Assignee: Olympus Optical Company, Ltd., Tokyo, Japan

[21] Appl. No.: 814,116

[22] Filed: Jul. 8, 1977

[30] Foreign Application Priority Data

Aug. 13, 1976 [JP] Japan ..... 51-107552[U]

[51] Int. Cl.$^2$ ..... G03G 15/10

[52] U.S. Cl. ..... 118/650; 118/662

[58] Field of Search ..... 118/650, 662, 651, 661, 118/647

[56] References Cited

U.S. PATENT DOCUMENTS

| | | | |
|---|---|---|---|
| 3,147,147 | 9/1964 | Carlson | 118/650 |
| 3,257,223 | 6/1966 | King | 118/647 X |
| 3,605,693 | 9/1971 | Zweig | 118/650 |
| 3,778,144 | 12/1973 | Hudson | 118/650 X |
| 3,991,712 | 11/1976 | Genthe et al. | 118/647 |

*Primary Examiner*—Werner H. Schroeder
*Assistant Examiner*—Andrew M. Falik
*Attorney, Agent, or Firm*—Haseltine, Lake & Waters

[57] ABSTRACT

A wet developing stationary electrode for wet-developing an electrostatic latent image produced on a record sheet. The electrode is provided at that surface thereof which is opposed to the electrostatic latent image produced surface of the record sheet with a number of strip-shape electrodes acting as developing electrodes and extending along two directions symmetrically inclined with respect to the advancing direction of the record sheet, the rear ends of the strip-shaped electrodes, viewed in the advancing direction of the record sheet, being divergent toward the front ends thereof.

6 Claims, 6 Drawing Figures

WET-DEVELOPING STATIONARY ELECTRODE

FIELD OF THE INVENTION

This invention relates to a wet-developing stationary electrode for wet-developing an electrostatic latent image produced on a record sheet.

BACKGROUND

In the case of developing an electrostatic latent image produced on a record sheet with the aid of developing solution containing colored pulverized powders suspended therein (hereinafter called toner particles), for example, the toner particles are electrically charged with a polarity which is reverse that of the electrostatic latent image so as to make use of the electrophoresis of the toner particles for the purpose of converting the electrostatic latent image to a visual image.

In order to accelerate the electrophoresis of the toner particles, that is, in order to effectively adhere the toner particles to the electrostatic latent image, it has been known to provide a counter electrode opposed to the electrostatic latent image surface. It has also been proposed to arrange this counter electrode at a position spaced apart from the electrostatic latent image surface by a distance of the order of 20 $\mu$ in order to adhere the toner particles to the electrostatic latent image in the most efficient manner. For this purpose, roller counter electrodes have generally been considered as the most efficient counter electrode.

Experimental tests have yielded the result that the use of roller electrodes whose number is so increased that the electrostatic latent image is sufficiently saturated with the toner particles ensures an improvement of various developing characteristics. However, the use of such large number of roller electrodes results in an increase of the number of driving mechanisms thereof, thereby rendering the developing device as a whole expensive. In order to eliminate such drawbacks, heretofore, it has been proposed to use a stationary electrode composed of a guide member for guiding the transfer of the record sheet in the developing solution and exhibiting an effect comparable with that of the roller electrode.

Such conventional stationary electrode is composed of an electrically conductive plate provided with a number of punched holes each having a diameter of the order of 1 mm and spaced apart from each other by a distance of the order of 2 mm or is composed of an electrically conductive plate provided with a number of strip-shaped grooves arranged transversely to the advancing direction of the record sheet. The former stationary electrode, however, has the disadvantage that electric lines of force become irregular and cause the visual image to produce a strip-pattern. In the latter stationary electrode, there is the risk that the record sheet can become clogged, and as a result, the latter stationary electrode is very inconvenient to be used as the guide member for guiding the transfer of the record sheet in the developing solution.

SUMMARY OF THE INVENTION

An object of the invention, therefore, is to provide a wet-developing stationary electrode for wet-developing an electrostatic latent image produced on a record sheet, which can eliminate the above mentioned disadvantages which have been encountered with the prior art techniques and hence is capable not only of producing uniform electric lines of force but also of functioning as a guide member for smoothly guiding the transfer of a record sheet without clogging it.

A feature of the invention is the provision of a wet-developing stationary electrode for wet-developing an electrostatic latent image produced on a record sheet, comprising a number of strip-shaped electrodes each acting as a developing electrode and opposed to that surface of said stationary electrode on which is produced the electrostatic latent image, said strip-shaped electrodes extending along two directions symmetrically inclined with respect to the advancing direction of the record sheet and having rear ends, viewed in the advancing direction of the record sheet, which are divergent toward the front ends thereof.

BRIEF DESCRIPTION OF THE DRAWINGS

The invention will now be described in greater detail with reference to the accompanying drawings, wherein.

DETAILED DESCRIPTION

Figure 1:
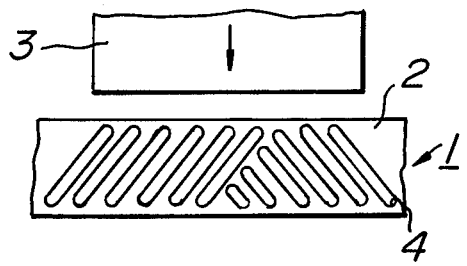
FIG. 1 is a plan view of one embodiment of a wet-developing stationary electrode according to the invention.

In FIG. 1 is shown one embodiment of a wet-developing stationary electrode according to the invention. In the embodiment, a stationary electrode 1 is composed of an electrically conductive plate 2 which operates as a developing electrode and as a record sheet guide member and which is provided with a number of grooves 4 extending along two directions symmetrically inclined with respect to the lengthwise direction of a record sheet 3. The rear ends of the grooves 4, viewed in the advancing direction of the record sheet 3 as shown by the arrow in FIG. 1, are divergent toward the front ends thereof. The use of such grooves 4 whose rear ends are divergent toward the front ends thereof with respect to the advancing direction of the record sheet 3 causes the record sheet 3 opposed to the stationary electrode 1 to be widened in the widthwise direction thereof, so that the front end of the record sheet 3 is not clogged in the groove 4. As a result, the record sheet 3 can advance while maintaining its flatness. In this case, the electrostatic latent image surface of the record sheet 3 advances while uniformly opposed to strip-shaped electrodes each formed between two adjacent grooves 4, and as a result, it is possible to uniformly develop the electrostatic latent image produced on the record sheet 3 into a visual image.

Figure 2A:
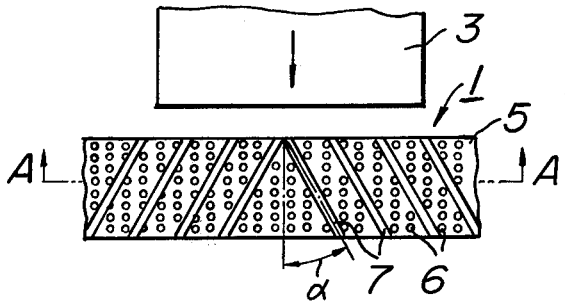
FIG. 2*a* is a plan view of another embodiment of a wet-developing stationary electrode according to the invention.

In FIG. 2*a* is shown another embodiment of a wet-developing stationary electrode according to the invention. In this embodiment, the stationary electrode 1 is composed of an electrically conductive or insulating plate 5 which is provided with a number of small holes as in the case of the above mentioned conventional punched metal plate. In accordance with the invention, on such punched plate 5 are arranged a number of electrically conductive wires 7 extending along two directions symmetrically inclined with respect to the advancing direction of the record sheet 3 as shown by the arrow in FIG. 2*a*. The rear ends of the wires 7, viewed in the advancing direction of the record sheet 3, are divergent toward the front end thereof.

The wires 7, arranged as described above, operate not only to guide the record sheet 3 but also to uniformly subject the developing action thereof the elecrostatic latent image surface of the record sheet 3, thereby uniformly effecting the developing treatment.

In addition, as seen from FIG. 2*a* even when the record sheet 3 is opposed to the stationary electrode 1, the developing solution containing the toner particles is evenly circulated through the small holes 6 among the electrically conductive wires 7, thereby improving the quality of the developed picture.

Figure 3A:
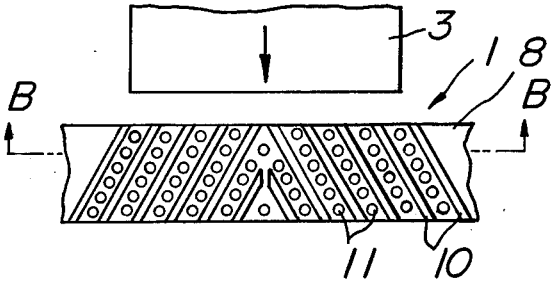
FIG. 3*a* is a plan view of a further embodiment of a wet-developing stationary electrode according to the invention.

In FIG. 3*a* is shown a further embodiment of a wet-developing stationary electrode according to the invention. In this embodiment, the stationary electrode 1 is composed of an insulating plate 8 which is provided beforehand with a number of ridges 9 extending along two directions symmetrically inclined with respect to the advancing direction of the record sheet 3 as shown by the arrow in FIG. 3*a*, and having rear ends divergent toward the front ends thereof.

Figure 2B:
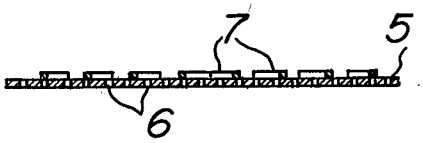
FIG. 2*b* is a section taken on line A—A in FIG. 2*a;*

In this embodiment, the ridges 9 are coated with electrically conductive plated layers 10, respectively. The insulating plate 8 is provided at that portion thereof which is not inclusive of the ridges 9 with a number of small holes 11 in the same manner as in the case of the embodiment shown in FIGS. 2*a* and 2*b*.

The present embodiment is capable of not only guiding the record sheet 3 but also uniformly subjecting the developing action of the electrically conductive plated layer 10 to the electrostatic latent image surface of the record sheet 3, thereby uniformly effecting the developing treatment. In addition, the developing solution containing the toner particles can circulate through the small holes 11 among the ridges 9 thereby improving the quality of the developed picture.

Figure 4:
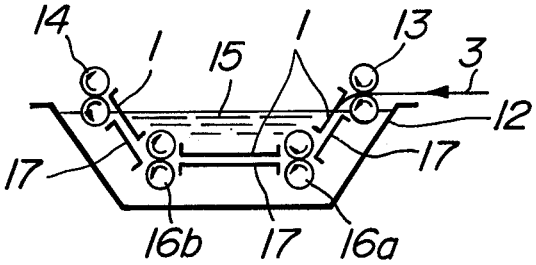
FIG. 4 is a schematic view illustrating the use of the wet-developing stationary electrode according to the invention in one embodiment of a developing device.

In FIG. 4 is shown one embodiment of a developing device which makes use of a wet-developing stationary electrode according to the invention. In this embodiment, a developing tank 12 is provided at its inlet and outlet sides with a pair of take-up rollers 13 and a pair of squeeze rollers 14, respectively. In the developing solution 15 are arranged two pairs of developing electrode rollers 16*a*, 16*b*.

The stationary electrode 1 according to the invention is arranged between take-up rollers 13 and the developing electrode rollers 16*a*, between the developing electrode rollers 16*a*, 16*b* and between the squeeze rollers 14 and the developing electrode rollers 16*b*, respectively, and is opposed to the electrostatic latent image surface of the record sheet 3. In addition, provision is made for a guide member 17 located at a position opposed through the record sheet 3 to the stationary electrode 1.

In the developing device shown in FIG. 4, the record sheet 3 is guided by the stationary electrode 1 and the guide member 17 and passes through the two pairs of electrode rollers 16*a* 16*b*. As described above, the stationary electrode 1 is provided with the strip-shaped electrodes acting as the developing electrodes and extending along two directions symmetrically inclined with respect to the advancing direction of the record sheet such that the rear ends of the strip-shaped electrodes 1 viewed in the advancing direction of the record sheet, are divergent toward the front ends thereof. As a result, there is no risk of the record sheet 3 being clogged on the stationary electrode 1. In addition, the developing effect of the strip-shaped electrodes is uniformly subjected to the electrostatic latent image surface of the record sheet 3, thereby preventing irregular developing treatment.

As stated hereinbefore, the use of the strip-shaped electrodes acting in the same manner as the developing electrode and having the rear ends, viewed in the advancing direction of the record sheet, divergent toward the front ends thereof, provides the important advantage that there is no risk of the record sheet being clogged and that the developing effect of the developing electrode can uniformly be subjected to the electrostatic latent image surface of the record sheet.

Figure 3B:
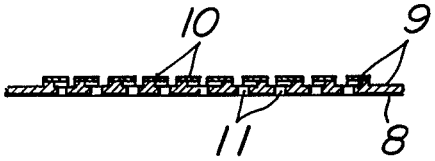
FIG. 3*b* is a section taken on line B—B in FIG. 3*a;*.

The invention is not limited to the above described embodiments and many modifications and alternations may be made. For example, each of the stationary electrodes shown in FIGS. 2 and 3 is provided at that portion thereof which is exclusive of the strip-shaped electrodes with a number of small holes so as to improve circulation of the developing solution among the strip-shaped electrodes. But, it is not always necessary to provide such small holes since even when the small holes are absent the developing solution can circulate among the strip-shaped electrodes.

What is claimed is:

1. In a wet-developing stationary electrode for wet-developing an electrostatic latent image produced on a record sheet, the electrode comprising a plate, the improvement comprising a number of strip-shaped electrodes each acting as a developing electrode and opposed to that surface of said record sheet on which is produced said electrostatic latent image, said strip-shaped electrodes extending along two directions symmetrically inclined with respect to the advancing direction of said record sheet and having rear ends, viewed in the advancing direction of said record sheet, which are divergent toward the front ends thereof, said plate having hole means distributed between said strip-shaped electrodes.

2. The stationary electrode according to claim 1 wherein said plate of said electrode is electrically conductive and acts as a guide member, said hole means extending along elongate lines between adjacent electrodes.

3. The wet-developing stationary electrode according to claim 1 wherein said strip-shaped electrodes comprise electrically conductive wires on said plate.

4. The wet-developing stationary electrode according to claim 1 wherein said plate is insulating and said strip-shaped electrodes comprise a number of ridges on said plate, said ridges being coated with electrically conductive plated layers, respectively.

5. The wet-developing stationary electrode according to claim 3 wherein said hole means is constituted by a number or small holes disposed in said plate between the wires.

6. The wet-developing stationary electrode according to claim 4 wherein said hole means is constituted by a number of small holes disposed in said insulating plate between said ridges.

* * * * *